US006273626B1

(12) United States Patent
Yazawa

(10) Patent No.: US 6,273,626 B1
(45) **Date of Patent: *Aug. 14, 2001**

(54) GRIP FOR A WRITING INSTRUMENT

(75) Inventor: Teruya Yazawa, Tokyo (JP)

(73) Assignee: Zebra Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/201,088

(22) Filed: Nov. 30, 1998

(51) Int. Cl.[7] ..... B43K 23/008
(52) U.S. Cl. ..... 401/6
(58) Field of Search ..... 401/6, 88; D19/45, D19/48, 55; 16/DIG. 12

(56) References Cited

U.S. PATENT DOCUMENTS

| | | | | |
|---|---|---|---|---|
| Re. 34,194 | * | 3/1993 | Stowell et al. | 16/DIG. 12 |
| D. 240,817 | * | 8/1976 | Funahashi | 401/6 |
| 2,173,451 | * | 9/1939 | Lorber | 401/6 |
| 2,996,044 | * | 8/1961 | Parker | 401/6 |
| 4,601,598 | * | 7/1986 | Schwartz et al. | 401/88 |
| 4,932,800 | * | 6/1990 | Lin et al. | 401/6 |
| 5,056,945 | * | 10/1991 | Klodt | 401/6 |

FOREIGN PATENT DOCUMENTS

| | | | | |
|---|---|---|---|---|
| 1511325 | * | 7/1969 | (DE) | 401/6 |
| 3406522 | * | 9/1985 | (DE) | 401/6 |
| 7-20752 | | 3/1995 | (JP) . | |
| 10181274 | | 7/1998 | (JP) . | |

OTHER PUBLICATIONS

An English Language abstract of JP 7–20752.
An English Language abstract of JP 10–181274.

* cited by examiner

*Primary Examiner*—Charles R. Eloshway
(74) *Attorney, Agent, or Firm*—Greenblum & Bernstein, P.L.C.

(57) ABSTRACT

A grip for a writing instrument for mounting about a barrel of a pen or pencil. The grip includes a resilient main body, the inner circumference thereof being smaller at one section of the length of the grip than at another section of the length of the grip. Also provided is a plurality of plate-like protrusions arranged on at least a portion of the outer circumference of the main body, each plate-like protrusion radially extending from the main body, one portion of the plurality of plate-like protrusions protruding a greater amount at one location of the length of the grip than the protrusion of another portion of the plurality of plate-like protrusions at another location of the length of the grip.

7 Claims, 6 Drawing Sheets

GRIP FOR A WRITING INSTRUMENT

BACKGROUND OF THE INVENTION

1. Field of the Invention

The invention relates to a grip for a writing instrument that is fitted to a cylinder barrel of a writing instrument such as a ball point pen, a mechanical pencil, or the like.

2. Description of Background Information

A prior art grip for a writing instrument is a cylinder constructed of a resilient material such as rubber, synthetic resin, or the like, wherein the grip is installed at an extremity of the writing instrument so as to improve the feel when the writing instrument is held with the fingers (discussed in Japanese Patent Publication No. Hei 7-20752).

Another known grip discusses a plurality of plate-like protrusions formed at an outer circumferential surface of the grip (discussed in Japanese Patent Laid-Open No. Hei 10-181274).

The grip of Hei 7-20752 is constructed such that the thickness of the cylinder is uniform over the entire length thereof.

The grip of Hei 10-181274 is constructed such that the height of the plate-like protrusions at the rear section of the grip is high, the outer diameter is large, and the height of the plate-like protrusions decreases toward the front section of the grip and its outer diameter is smaller than at the rear, as shown in FIG. 2 of this Japanese patent document.

Although such a prior art grip has a length corresponding to holding positions which are different in response to different users, the actual holding location ranges from a location near an intermediate part of a longitudinal direction (axial direction) to its forward section (i.e., toward the writing tip of the instrument). That is, as a result of performing an actual test for 50 users, even 48 persons held the grip at a range from the aforesaid location near an intermediate part to its forward section. In other words, only two persons held the grip at a point ranging from a location near the intermediate part of the grip to its rear section. As a person showed fatigue after writing for a long period of time, it was shown that the fingers slid to a forward section of the grip.

Accordingly, the prior art grips described in Hei 7-20752, in which a cylinder having substantially the same thickness over its entire length, and Hei 10-181274, in which an outer diameter decreases toward the front section, had problems such that they each have a surface structure that causes the fingers to easily forwardly slip after fatigue in writing many hours.

SUMMARY OF THE INVENTION

In view of the foregoing, it is an object of the present invention to provide an improved grip for a writing instrument that prevents slippage at an actual holding location.

It is another object of the present invention to provide an improved grip for a writing instrument which facilitates improved cushioning and a superior holding feeling.

Other objects will become more apparent in view of the detailed description and the drawings.

These objects are accomplished by the grip for the writing instrument provided by the present invention.

The grip for the writing instrument of the present invention has a plurality of plate-like protrusions arranged on at least a portion of an outer diameter of a main body, the main body made of resilient member. The projecting height of the plate-like protrusions at a location to be held is made higher than a projecting height at another location.

The holding location may be arranged at a forward section of the grip main body.

In addition, the holding location may be arranged at an intermediate part of the grip main body.

In addition, the plurality of plate-like protrusions may be arranged axially in the grip main body.

In addition, the plurality of plate-like protrusions may be arranged in a circumferential direction of the grip main body.

In addition, gaps may be provided between the grip main body and the cylinder barrel. Further, air may be sealed in the gaps, which may provide cushioning with air resistance.

Accordingly, in accordance with the present invention, the plate-like protrusions protrude a greater amount at a holding location than the protruding of the plate-like protrusions at another location. Thus, the protrusions deform a greater amount at a holding location than at another location, when gripped by the fingers.

In addition, gaps may be present between the grip main body and the writing instrument barrel to which the grip main body is fixed. Thus, when the grip is held with the fingers, the gaps are deformed to cause the finger tips to be more deeply sunk into the spaces.

DETAILED DESCRIPTION OF THE INVENTION

Figure 1:
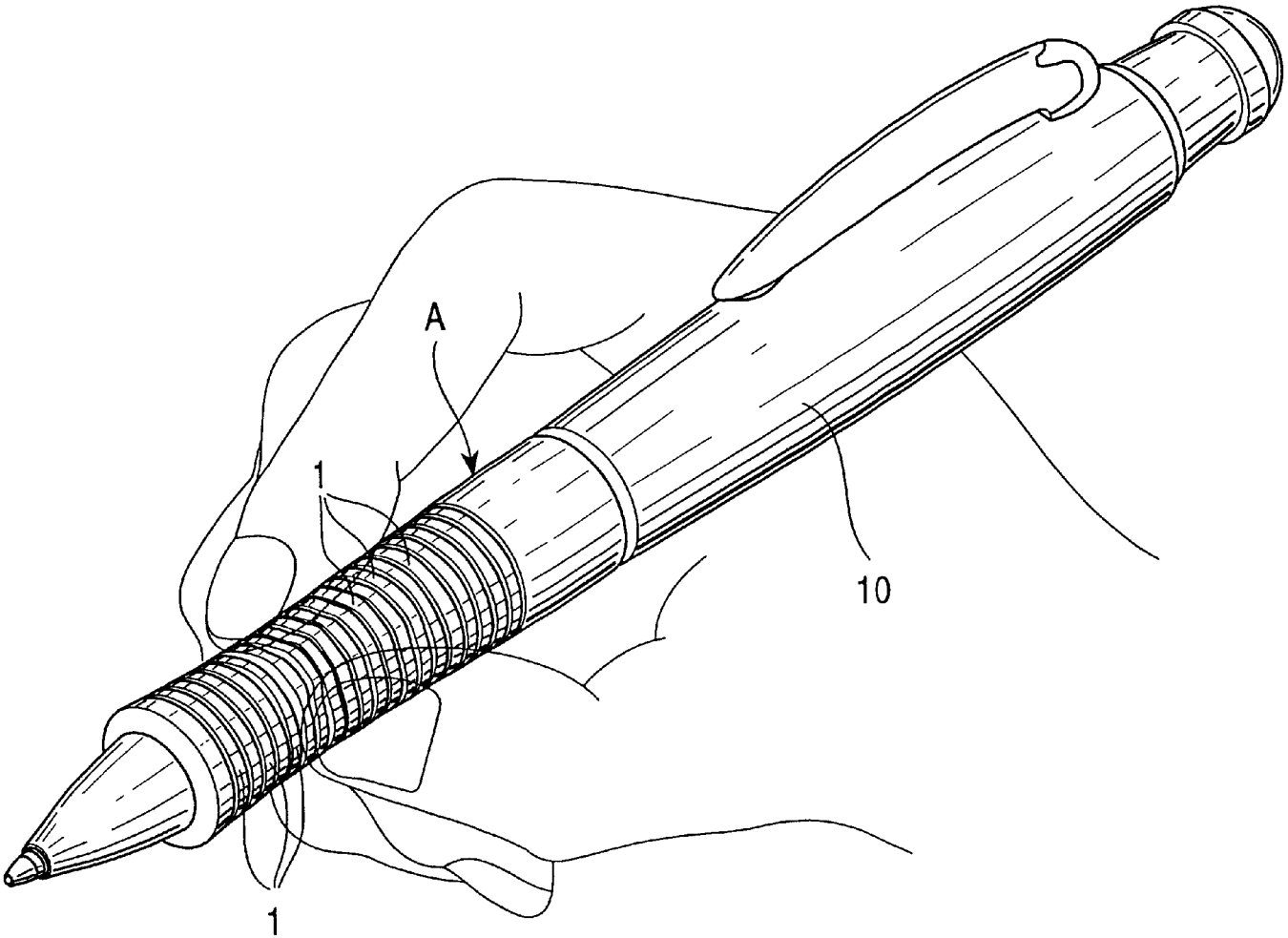
FIG. 1 is a perspective view for showing one preferred embodiment of a grip for a writing instrument of the present invention, indicating where the grip is fitted to a cylinder barrel.

Referring now to the drawings wherein like numerals represent like elements, preferred embodiments of the present invention will be described as follows.

Figure 2:
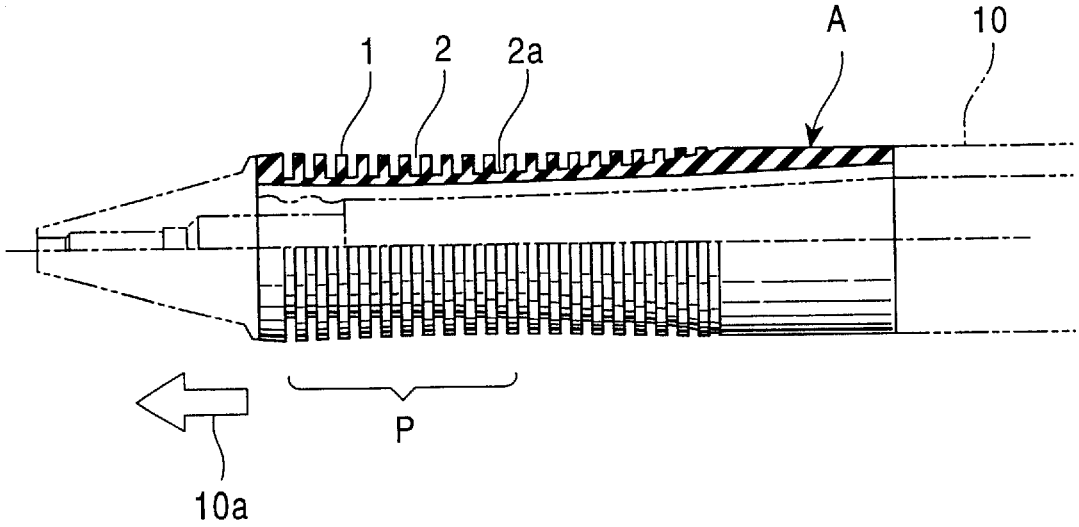
FIG. 2 is a semi-sectional view for showing the grip for the writing instrument.
Figure 3:
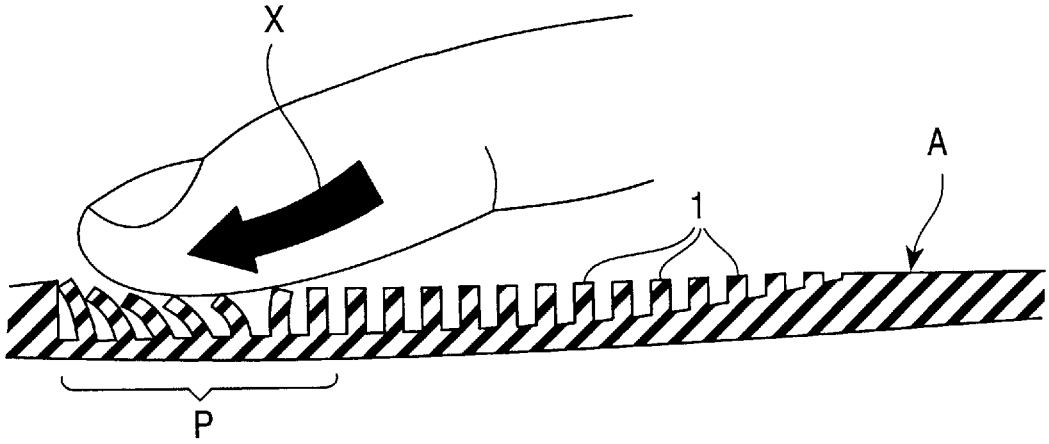
FIG. 3 is an enlarged sectional view for showing a substantial part to indicate a state of use at the grip for the writing instrument.

FIGS. 1–3 illustrate a grip main body A which is one example of a grip for a writing instrument of the present invention.

The grip main body A has a substantially cylindrical shape, and is made of a resilient material such as rubber (NBR, silicone), synthetic resin (soft resin, (soft resin, elastomer resin) or the like. The outer circumferential surface of the main body A has a plurality of plate-like protrusions 1 each radially protruding therefrom and each equally spaced apart along the axial length of the grip body. The grip is installed about a barrel cylinder 10 of a writing instrument.

As shown in FIG. 2, the grip main body A is constructed such that a respective bottom portion 2*a* of each of a plurality grooves 2 between a plurality of plate-like protrusions 1 is deeper at a holding location P where a forward part of the grip (toward the writing tip (indicated by an arrow 10*a*) as seen in FIG. 2) is held. A thickened portion is present between the holding location P and the forward part of the grip, as clearly shown in FIG. 2. The grooves gradually become more shallow toward a rear section (a right side in FIG. 2) of this holding location P. Thus, the protrusion height of each plate-like protrusion gradually increases toward a forward section of the grip body.

In addition, the plurality of plate-like protrusions 1 are arranged such that a distal end of a protrusion at location P at the forward section of the grip main body A and the outer diameter at the rear section of the grip main body are substantially the same distance from the center of the grip main body. Also, the outer diameter between the forward section and the rear section increases. Thus, the body A is formed into an indent-shaped drum in which a gradual curved line is drawn and its intermediate position is slightly indented.

When writing, the grip main body A having such a configuration is such that a forward pushing force is applied by a finger as indicated by an arrow X in FIG. 3 and the plate-like protrusions 1 pushed by the finger tip are pushed to a forward section and are deformed. At this time, since the protrusion height of the plate-like protrusions 1 at the holding location P is higher than that at another location, the plate-like protrusions 1 are substantially fixed and deformed and the finger tip sinks at holding location P. Thus, slippage of the fingers holding the grip is prevented. Further, cushioning of the finger is improved, resulting in an improved feel.

In view of the foregoing, the present inventors performed an evaluation test in regard to a slip-preventing effect and a holding feeling against 50 clerks with the writing instrument hold the grip main body A having the aforesaid configuration. As a comparison product, the present inventors used the grip for the writing instrument of the prior art described in the gazette of Japanese Patent Publication No. Hei 7-20752. As a result, 48 persons answered that the present invention resulted in superior anti-slipping and superior gripping, as compared with the aforesaid grip for a writing instrument of the prior art. Two respondents answered that they did not notice a difference. Thus, the present inventors determined that the present invention resulted in superior anti-slipping and superior gripping, as compared with the aforesaid grip for a writing instrument of the prior art, as described above.

Figure 4:
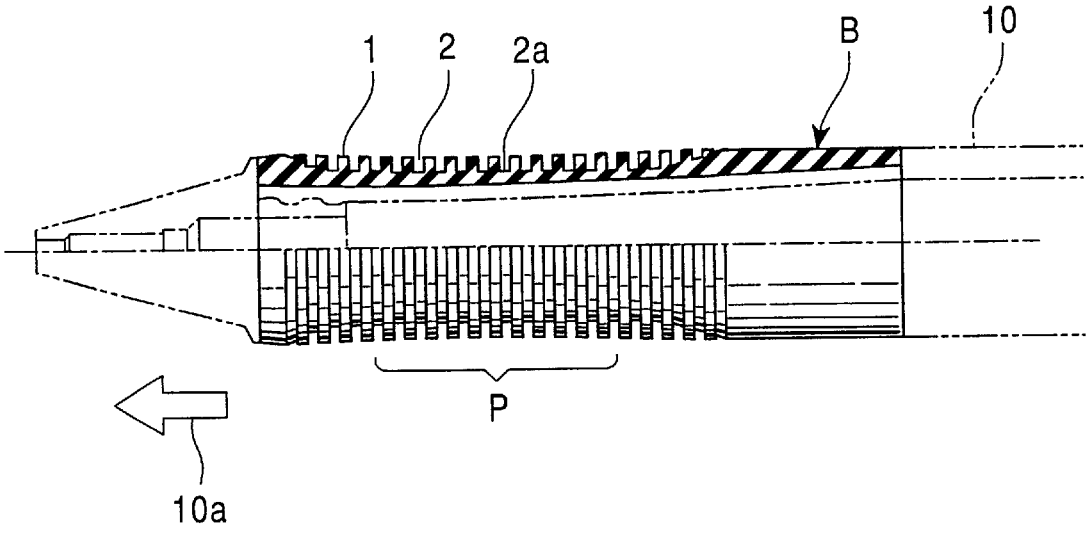
FIG. 4 is a semi-sectional view for showing a second embodiment of the grip for the writing instrument.
Figure 5:
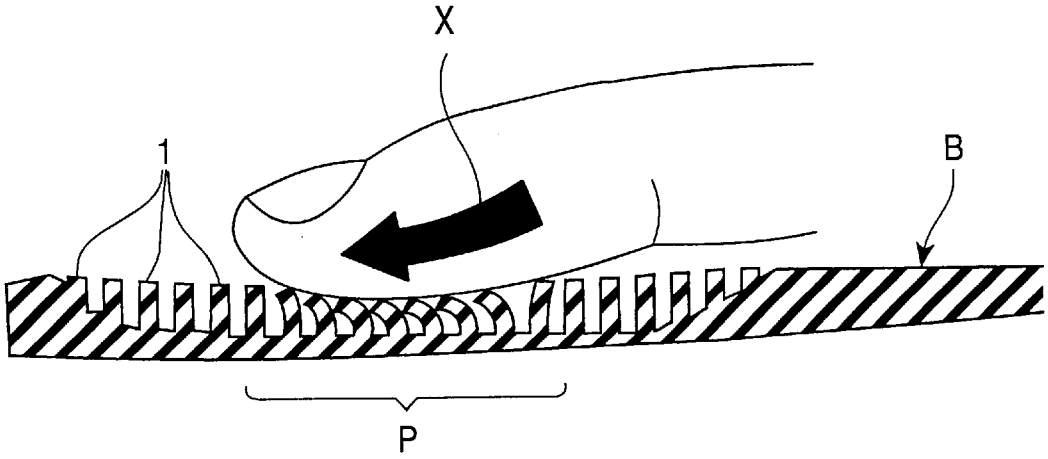
FIG. 5 is an enlarged sectional view for showing a substantial part to indicate a state of use at the grip for the writing instrument.
Figure 6:
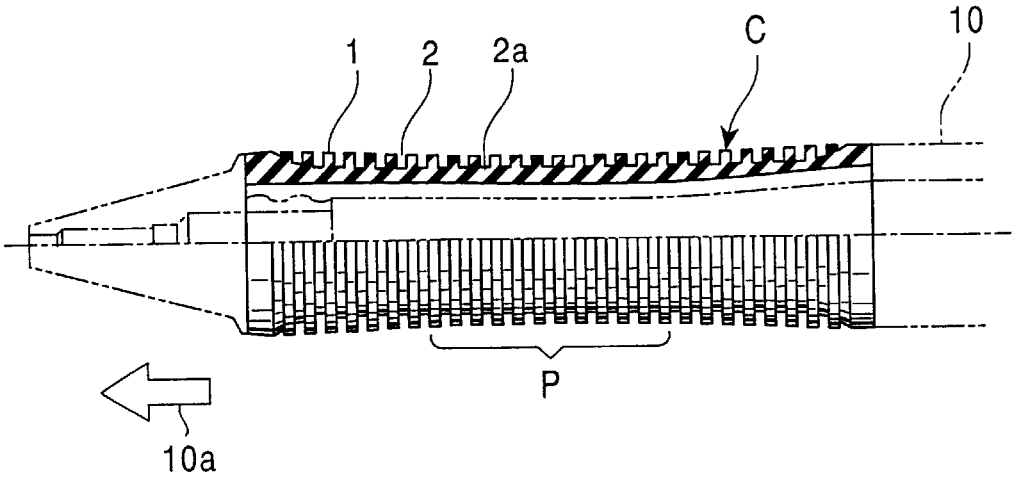
FIG. 6 is a semi-sectional view for showing a third preferred embodiment of the grip for the writing instrument of the present invention.

FIGS. 4–6 illustrate a grip main body B which is a second preferred embodiment of the grip for the writing instrument of the present invention.

Since the grip main body B is constructed similar to the grip main body A as described above, the same reference numerals are applied to the same portions in the figure to eliminate their dual description and only different elements will be described.

This grip main body B is formed such that each of the bottom portions 2*a* of the grooves 2 between a plurality of plate-like protrusions 1 is formed deep at the location P held near their intermediate portions and further formed to be gradually shallow at a forward section and a rear section of the holding location P.

The plate-like protrusions 1 are arranged such that their protrusion heights gradually increase from both the forward section and the rear section of the grip main body B, toward holding location P, which is proximate the intermediate section of the main body.

Thus, when writing, the finger force pushing the grip main body in a forward direction is applied as indicated by an arrow X in FIG. 5 to the grip main body B, the plate-like protrusions 1 are substantially flexed and deformed, thereby causing the finger tip to be sunk at a local position, due to the fact that the projecting height of the plate-like protrusions 1 is high at the holding location P. Thus, slippage of the fingers holding the grip is prevented. Further, cushioning of the finger is improved, resulting in an improved feel.

Although the grip main body A and grip main body B both have a plurality of plate-like protrusions 1 formed therein placed near their respective forward sections, plate-like protrusions 1 may be arranged along the entire length of the grip main body C shown in FIG. 6, representing a third embodiment.

In grip main body C, since the plurality of plate-like protrusions 1 are similar to those of the grip main body B, the same reference numerals are applied to the same portions to eliminate their dual description.

Figure 7:
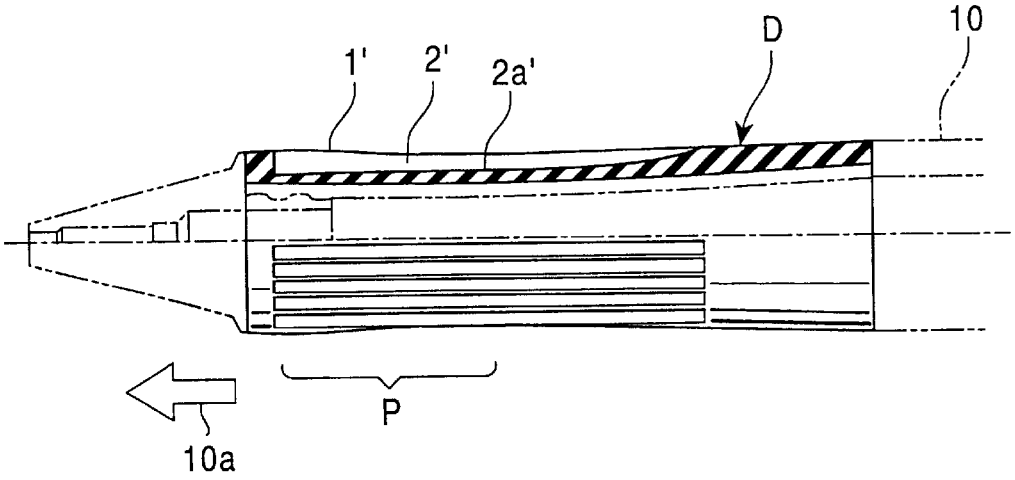
FIG. 7 is a semi-sectional view for showing a fourth preferred embodiment of the grip for the writing instrument of the present invention.

Referring to FIG. 7, the grip main body D showing a fourth preferred embodiment of the grip for the writing instrument of the present invention will be described.

Figure 8:
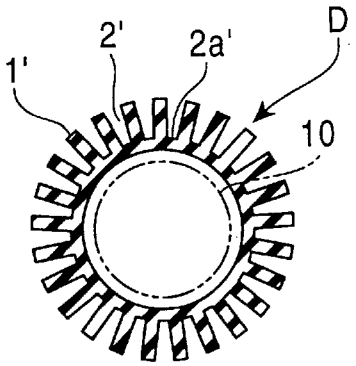
FIG. 8 is a cross sectional view for showing the grip for the writing instrument.

The grip main body D is a substantially cylindrical shape, and is made of a resilient material having the same material quality discussed supra, as well as a plurality of plate-like protrusions 1' radially extending and arranged in equal spaced-apart intervals in a circumferential direction as shown in FIGS. 7 and 8. The protrusions of the grip body show a radial cross-section at its outer circumferential surface. The grip is fitted to the cylinder barrel 10 of the writing instrument.

As shown in FIG. 7, each of the bottom portions 2*a*' of the grooves 2' between a plurality of plate-like protrusions 1' is formed deep at the holding location P at the forward section and gradually become shallow toward the holding location P.

When writing, the grip main body D is operated such that the plate-like protrusions 1' pushed by a finger tip are flexed and deformed in a circumferential direction. Since a projecting height of the plate-like protrusions 1' at the holding location P is high, the plate-like like protrusions 1' are substantially flexed and deformed to cause the finger tip to be sunk at the holding location P. Thus, slippage of the fingers holding the grip is prevented. Further, cushioning of the finger is improved, resulting in an improved feel.

Referring to FIGS. 9–13, the grip main body E showing a fifth preferred embodiment of the grip for the writing instrument of the present invention will be described as follows.

Since this grip main body E is constructed such that the configurations of the plate-like protrusions 1 at the outer circumferential surface are basically the same as those of the grip main body A shown in FIGS. 1–3, the same reference numerals are applied to the same portions in the figure to eliminate a dual description of them and only the different portions will be described.

Figure 9:
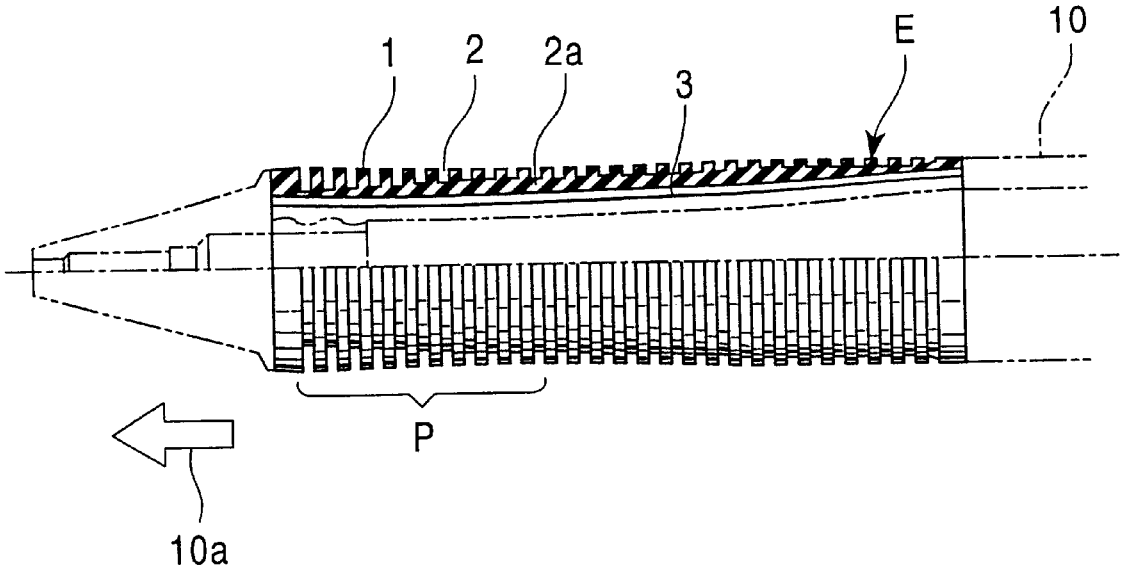
FIG. 9 is a semi-sectional view for showing a fifth preferred embodiment of the grip for the writing instrument of the present invention.
Figure 10:
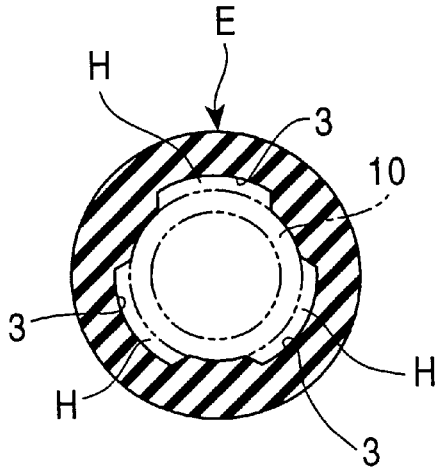
FIG. 10 is a cross sectional view for showing the grip for the writing instrument.

As shown in FIGS. 9–10, axial continuous groove-like gaps or recesses 3 are formed substantially in an equally spaced-apart relation at the inner circumferential surface of the grip main body E.

The recesses 3 may form spaced portions H between the inside part of the grip main body E and the outer circumferential surface of the cylinder barrel 10 (shown in FIG. 10).

Figure 11:
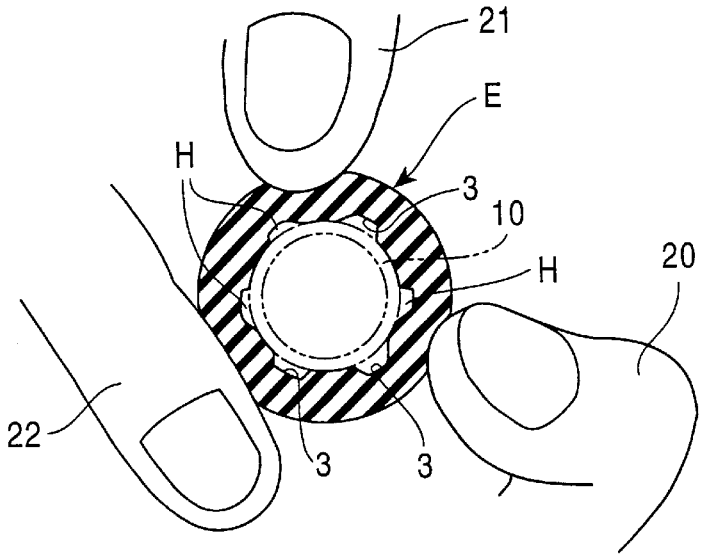
FIG. 11 is a cross sectional view for showing a state of use in the grip for the writing instrument.

In addition, air may be sealed in the spaces H as required. Further, when the grip main body E is held, the recesses 3 are equally spaced apart in a circumferential direction at an angle such that the grip main body is supported at the three points of the thumb 20, the fore-finger 21 and the middle finger 22, as shown in FIG. 11.

Thus, when writing, while the grip main body E is supported by three points of the thumb 20, the fore-finger 21 and the middle finger 22, the plate-like protrusions 1 are locally and substantially flexed and deformed at the supporting locations. Further, the recesses 3 are deformed by the spaces H and the fingers 20, 21 and 22 are sunk therein (referring to FIG. 11). With such an arrangement, slippage of the fingers holding the grip is prevented. Further, an air pocket is generated at the spaces H to provide cushioning of the fingers and a comfortable grip.

Figure 12:
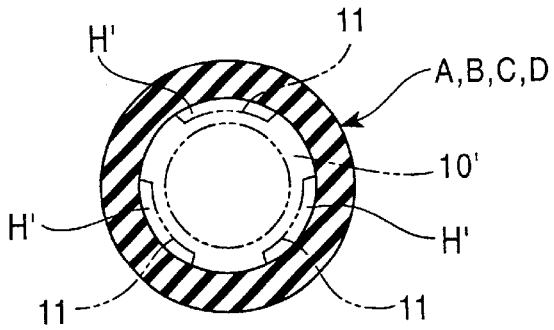
FIGS. 12–13 are cross sectional views for showing a sixth preferred embodiment of the grip for the writing instrument of the present invention.

In the aforesaid preferred embodiments, the recesses 3 are arranged at the inner circumference of the grip main body E to form the spaces H between the main body E and the cylinder barrel 10. However, as shown in FIG. 12, any one of the aforesaid grip main bodies A to D having no recesses may have recesses 11 formed therein and installed at the cylinder barrel 10'. In this case, single spaces H' are formed between the grip main bodies A (B, C, D) and the cylinder barrel 10', action similar to that of the aforesaid grip main body E is possible.

Figure 13:
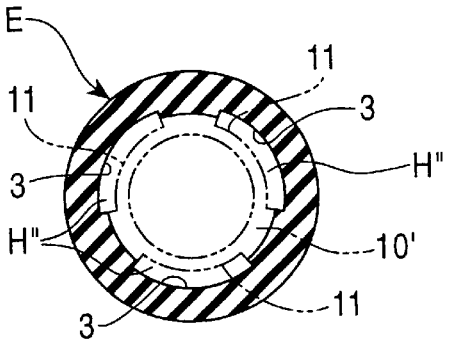

In addition, as shown in FIG. 13, the aforesaid grip main body C provided with the recesses 3 at its inner circumference is used and at the same time, a cylinder barrel 10' provided with recesses 11 at its outer surface may be used. Since the large spaces H" are formed by two recesses 3, 11, the fingers holding the grip may be further sunk therein and slippage of the fingers holding the grip is thus prevented. Further, cushioning of the finger is improved, resulting in an improved feel.

Since a plurality of plate-like protrusions are such that the projecting height of the holding location P is higher than a projecting height of another location, flexing and deformation of the plate-like protrusions at the holding location P are increased more than flexing and deformation of the protrusions at another location, resulting in the prevention of slippage of the fingers. Further, cushioning of the finger is improved, resulting in an improved feel. Additionally, a comfortable grip is provided, thereby reducing fatigue.

Additionally, gaps are provided between the grip main body and the cylinder barrel of the writing instrument. The gaps are deformed when the grip main body is held and the finger tips are sunk therein, resulting in the prevention of slippage of the fingers. Additionally, cushioning is improved by pressure generated by the air enclosed within the spaces due to deformation of the spaces. Also, a comfortable grip results, thereby reducing fatigue.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A grip for a writing instrument having a cap at a writing end portion of the writing instrument, said grip comprising:

a resilient main body having an outer circumference, an inner circumference and an axial length having a front section and a rear section, said inner circumference smoothly varying along said axial length;

a plurality of plate-like protrusions arranged on at least a portion of said outer circumference of said main body, each said plate-like protrusion extending outwardly from said main body, one portion of said plurality of plate-like protrusions protruding a greater amount at one location of said axial length, than the protrusion of another portion of said plurality of plate-like protrusions at another location of said axial length, said one portion of said plurality of plate-like protrusions being arranged at said front section of said axial length; and a thickened portion positioned adjacent to the cap side of said main body, the thickened portion being thicker than each of said plurality of plate-like protrusions in the axial length direction of the main body;

wherein said rear section forms a surface portion free from plate-like protrusions.

2. The grip according to claim 1, wherein each plate-like protrusion of said plurality of plate-like protrusions encircles said outer circumference of said body.

3. The grip according to claim 1, wherein respective diameters of said plurality of plate-like protrusions are substantially uniform with each other.

4. A grip for a writing instrument having a cap at a writing end portion of the writing instrument, said grip comprising:

a resilient main body having an outer circumference, an inner circumference and an axial length having a front section, an intermediate section and a rear section, said inner circumference smoothly varying along said axial length;

a plurality of plate-like protrusions arranged on at least a portion of said outer circumference of said main body, each said plate-like protrusion extending outwardly from said main body, one portion of said plurality of plate-like protrusions protruding a greater amount at one location of said axial length, than the protrusion of another portion of said plurality of plate-like protrusions at another location of said axial length, said one portion of said plurality of plate-like protrusions being arranged at said intermediate section of said axial length; and a thickened portion positioned adjacent to the cap side of said main body, the thickened portion being thicker than each of said plurality of plate-like protrusions in the axial length direction of the main body;

wherein said rear section forms a surface portion free from plate-like protrusions.

5. The grip according to claim 4, wherein each plate-like protrusion of said plurality of plate-like protrusions encircles said outer circumference of said body.

6. The grip according to claim 4, wherein respective diameters of said plurality of plate-like protrusions are substantially uniform with each other.

7. A grip for a writing instrument having a cap at a writing end portion of the writing instrument, said grip comprising:

a resilient main body having an outer circumference, an inner circumference and an axial length, wherein said inner circumference smoothly varies from said one section of said axial length to said another section of said axial length; and a plurality of plate-like protrusions arranged on at least a portion of said outer circumference of said main body, each plate-like protrusion of said plurality of plate-like protrusions extending outwardly from said main body, one portion of said each plate-like protrusion protruding a greater amount at one location of said axial length than the protrusion of another portion of said each plate-like protrusion at another location of said axial length.

* * * * *